US009389015B2

(12) United States Patent
Sapper et al.

(10) Patent No.: US 9,389,015 B2
(45) Date of Patent: Jul. 12, 2016

(54) METHOD FOR SEPARATING C2+-HYDROCARBONS OR C3+-HYDROCARBONS FROM A HYDROCARBON-RICH FRACTION

(71) Applicant: LINDE AKTIENGESELLSCHAFT, Munich (DE)

(72) Inventors: Rainer Sapper, Aufkirchen (DE); Jurgen Witte, Munich (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 554 days.

(21) Appl. No.: 14/016,309

(22) Filed: Sep. 3, 2013

(65) Prior Publication Data

US 2014/0060113 A1 Mar. 6, 2014

(30) Foreign Application Priority Data

Sep. 4, 2012 (DE) ..... 10 2012 017 485

(51) Int. Cl.
*F25J 3/06* (2006.01)
*F25J 3/02* (2006.01)

(52) U.S. Cl.
CPC ..... *F25J 3/061* (2013.01); *F25J 3/0209* (2013.01); *F25J 3/0233* (2013.01); *F25J 3/0238* (2013.01); *F25J 3/0242* (2013.01); *F25J 2200/02* (2013.01); *F25J 2200/40* (2013.01); *F25J 2200/76* (2013.01); *F25J 2205/04* (2013.01); *F25J 2240/02* (2013.01); *F25J 2245/02* (2013.01); *F25J 2280/02* (2013.01)

(58) Field of Classification Search
CPC ..... F25J 3/0233; F25J 3/0238; F25J 3/0242; F25J 3/0247; F25J 3/0295; F25J 2200/40; F25J 3/0487; F25J 3/04793; F25J 3/04484; B01D 3/14; B01D 3/32; B01D 3/4238; B01D 3/4244; B01D 3/4255; B01D 3/4261–3/4277
USPC ..... 203/25, 26
See application file for complete search history.

(56) References Cited

U.S. PATENT DOCUMENTS 5,568,737 A 10/1996 Campbell et al.
2004/0159122 A1* 8/2004 Patel ..... F25J 3/0209 62/620

(Continued)

*Primary Examiner* — Frantz Jules
*Assistant Examiner* — Brian King
(74) *Attorney, Agent, or Firm* — Millen, White, Zelano, Branigan, P.C.

(57) ABSTRACT

Described herein is a method for separating $C_{2+}$-hydrocarbons or $C_{3+}$-hydrocarbons from a hydrocarbon-rich fraction is described, whereby the separation is carried out in a rectification fractionation. The rectification fractionation is provided with at least three heating circuits via which intermediate fractions are drawn off from rectification fractionation, partially evaporated and fed back again to rectification fractionation. In the method, removal of the intermediate fraction circulating in the heating circuit located at the highest temperature level is at least temporarily interrupted. During this interruption, a partial stream of a bottom fraction from the rectification fractionation is partially evaporated against an external medium and is fed as a bottom heating to the rectification fractionation. Also during this interruption, the two additional intermediate fractions, in each case at the temperature level at which the intermediate fraction circulating in the heating circuit located at the next-higher temperature level was partially evaporated, are partially evaporated.

8 Claims, 1 Drawing Sheet

(56) References Cited

U.S. PATENT DOCUMENTS

2008/0078205 A1* 4/2008 Cuellar ..... F25J 3/0209 62/620

2008/0282731 A1* 11/2008 Cuellar ..... C10L 3/10 62/620

2009/0293537 A1* 12/2009 Ameringer ..... F25J 3/0209 62/620

* cited by examiner

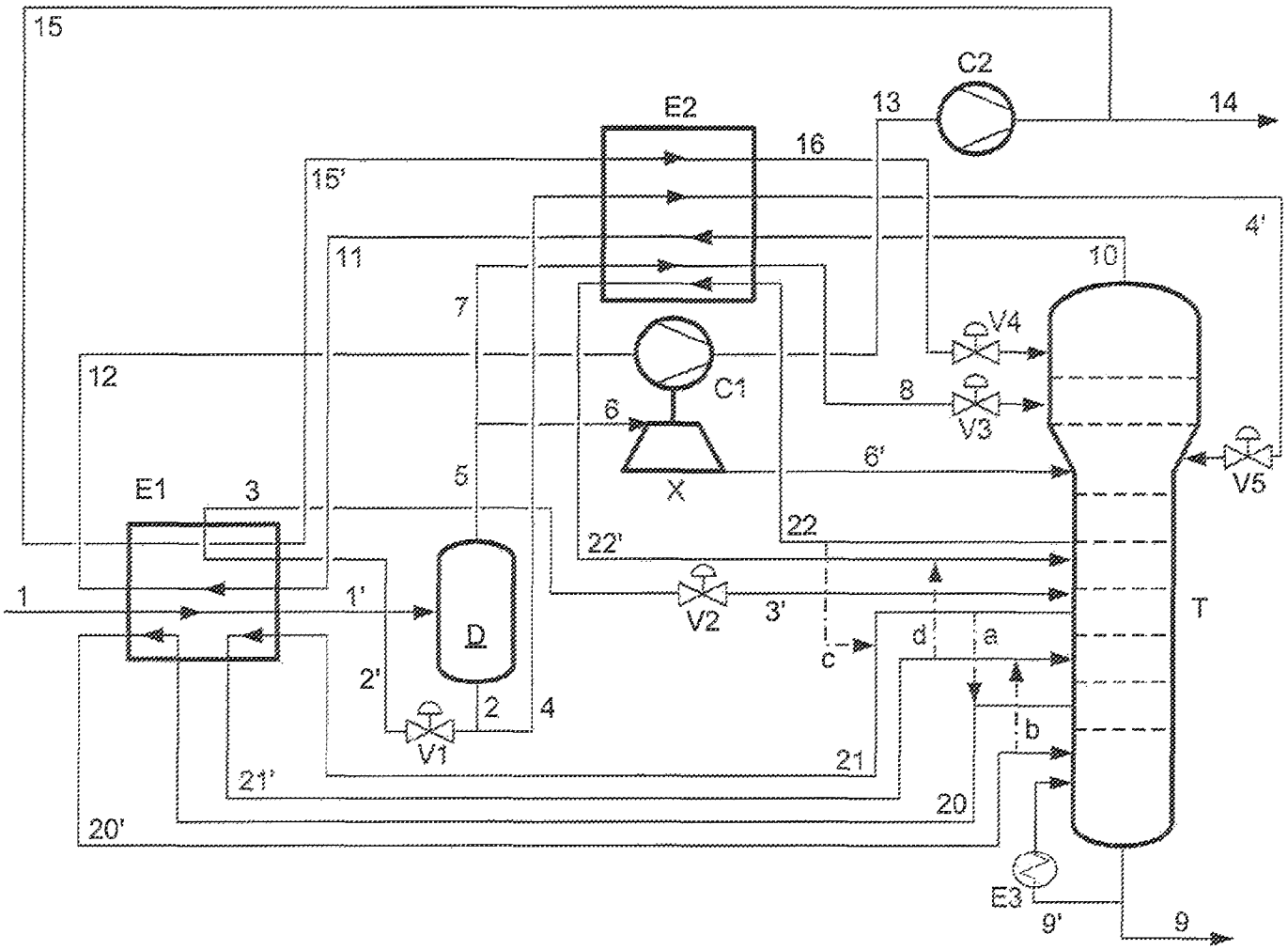
14
4'
V5
T
9
10
C2
V4
V3
E3
9'
13
8
6'
a
b
d'
20
16
22
c
21
3'
C1
V2
E2
X
6
22'
4
2
D
7
5
V1
2'
11
1'
15'
3
21'
E1
12
20'
15
1

METHOD FOR SEPARATING C2+-HYDROCARBONS OR C3+-HYDROCARBONS FROM A HYDROCARBON-RICH FRACTION

FIELD OF THE INVENTION

The invention relates to a method for separating $C_{2+}$-hydrocarbons or $C_{3+}$-hydrocarbons from a hydrocarbon-rich fraction, in particular from natural gas, whereby a) the hydrocarbon-rich fraction is partially condensed,
b) is separated into a gaseous fraction and a liquid fraction,
c) these fractions are subjected to a rectification fractionation into a methane-rich fraction and a $C_{2+}$- or $C_{3+}$-hydrocarbon-rich fraction,
d) the methane-rich fraction obtained in the rectification fractionation is compressed,
e) a partial stream of the compressed methane-rich fraction is condensed and is fed as reflux to the rectification fractionation,
f) at least three heating circuits—via which intermediate fractions are drawn off from rectification fractionation, partially evaporated and fed again to the rectification fractionation—are assigned to the rectification fractionation, and
g) at least the intermediate fractions circulating in the two heating circuits located at the highest temperature levels are partially evaporated against the hydrocarbon-rich fraction that is to be partially condensed.

A general method for separating C2+-hydrocarbons from a hydrocarbon-rich fraction is known from U.S. Pat. No. 5,568,737. As described therein a partial stream of the compressed methane-rich fraction is condensed and recycled as reflux to rectification fractionation. This recycling of the partial stream is referred to as so-called light sales gas recycling. By means of this method using light sales gas recycling, the yield of $C_{2+}$-hydrocarbons can be significantly increased, in comparison to performing the method without sales gas recycling.

The ethane product that is obtained by means of the general method is frequently used as feedstock in an olefin complex, for example a chemical plant which produces olefins by steam cracking of natural gas liquids like ethane and propane. Construction of the olefin complex is sometimes completed only after the natural gas unit, in which the generic method is implemented. Therefore, it happens that at the start-up of the operation of the natural gas unit—but also for other reasons or at other times—a $C_{3+}$-hydrocarbon-rich fraction with a high $C_3$ yield is obtained, rather than a $C_{2+}$-hydrocarbon-rich fraction. The current topology of the $C_{2+}$-separation does not allow such an approach.

The object of this invention is to provide a general method for separating $C_{2+}$-hydrocarbons or $C_{3+}$-hydrocarbons from a hydrocarbon-rich fraction, which can be operated at least temporarily in such a way that instead of the $C_{2+}$-hydrocarbon-rich fraction, a $C_{3+}$-hydrocarbon-rich fraction is obtained.

SUMMARY OF THE INVENTION

Upon further study of the specification and appended claims, other objects, aspects and advantages of the invention will become apparent.

To accomplish these objects, a method for separating $C_{2+}$-hydrocarbons or $C_{3+}$-hydrocarbons from a hydrocarbon-rich fraction is proposed, which is characterized in that at least temporarily, removal of the intermediate fraction circulating in the heating circuit located at the highest temperature level is interrupted, during the temporary interruption of removal of the intermediate fraction circulating in the heating circuit located at the highest temperature level, a partial stream of a bottom fraction obtained from the rectification fractionation is partially evaporated against an external medium (reboiler) and is fed as a bottom heating to the rectification fractionation, and during the temporary interruption of removal of the intermediate fraction circulating in the heating circuit located at the highest temperature level, the additional intermediate fractions, in each case at the temperature level at which the intermediate fraction circulating in the heating circuit located at the next-higher temperature level was partially evaporated, are partially evaporated.

If a $C_{3+}$-hydrocarbon-rich fraction is now to be obtained from the hydrocarbon-rich (feedstock) fraction instead of the $C_{2+}$-hydrocarbon-rich fraction, the intermediate fractions circulating in the heating circuits assigned to the rectification fractionation in each case are partially evaporated at a higher temperature level according to the invention. Moreover, the removal of the intermediate fraction circulating in the heating circuit located at the highest temperature level is interrupted, and instead of this, a partial stream of the bottom fraction that is obtained from the rectification fractionation is partially evaporated against an external medium and is fed as a bottom heating to rectification fractionation.

By this method, the bottom temperature and the overall temperature profile of the demethanizer T—which under these conditions acts as a deethanizer—can be noticeably raised, so that an at least temporary separation of $C_{3+}$-hydrocarbons can be implemented.

Other advantageous configurations of the method according to the invention for separating $C_{2+}$-hydrocarbons from a hydrocarbon-rich fraction are characterized in that the liquid fraction obtained in process step b) is separated into two partial liquid streams, whereby the first partial liquid stream is preferably partially evaporated and then is fed to rectification fractionation, the second partial liquid stream is subcooled and then fed as additional reflux to the rectification fractionation, the evaporation pressure of the first partial liquid stream is variable, the second partial liquid stream is subcooled against the methane-rich fraction obtained from the rectification fractionation, and the subcooled second partial stream is fed as reflux to the rectification fractionation at a point below the feed point of a reflux that is formed by a partial stream of the methane-rich fraction.

BRIEF DESCRIPTION OF THE DRAWINGS

The method according to the invention for separating $C_{2+}$-hydrocarbons or $C_{3+}$-hydrocarbons from a hydrocarbon-rich fraction as well as additional advantageous configurations thereof are explained in more detail below based on the embodiment that is depicted in FIG. 1.

Via line 1, the hydrocarbon-rich (feedstock) fraction is fed to the heat exchanger E1 and is partially condensed in the latter against process streams that are to be heated, which will be explained in greater detail below. The hydrocarbon-rich fraction is then fed via line 1' to a separator D and separated in the latter into a gaseous fraction 5 and a liquid fraction 2. In turn, the liquid fraction 2 is divided into two partial streams 2' and 4. The first partial stream 2' is partially evaporated in the heat exchanger E1 against the hydrocarbon-rich fraction 1 that is to be condensed, and is then fed via the line sections 3 and 3' to rectification fractionation or a demethanizer T. By means of the valves V1 and V2, the evaporation pressure can be varied, and the optimal approach can be adjusted accordingly. This is achieved by an improvement of the Q/T profile in the heat exchanger E1. By adjustment of the evaporation pressure of the first partial stream the resulting Q/T composite curve approach can be optimized thus resulting in a more energy efficient operation.

The second partial stream 4 is sub-cooled in the heat exchanger E2 against process streams, which will be explained in greater detail below, and is fed via line 4' and expansion valve V5 as additional reflux to the rectification fractionation or to the demethanizer T In this connection, this additional reflux is preferably introduced into the rectification fractionation/demethanizer at a point below the feed point of a reflux stream 16, which will be explained in greater detail below. The previously-described way in which this method is performed improves the Q/T profile of the heat exchanger E2 by adjusting the flow rate of the second partial liquid stream to heat exchanger E2.

By means of the previously-described division of the liquid fraction 2 and the use of a partial stream as additional reflux 4', amount of the reflux derived from the compressed methane-rich fraction can be reduced under the postulation of unaltered yields. As a result, this leads to a reduction in output of up to 5% at the compressors C1 and C2 that are necessary for the compression of the methane-rich fraction. In this connection, the reduction in output is all the greater the heavier the hydrocarbon-rich feedstock fraction 1. The heavier the hydrocarbon rich feed stock is, the greater is the additional subcooled reflux to the demethanizer, and the lower is the energy consumption of the sales gas compressor.

The gaseous fraction 5 that accumulates in the separator D is also divided into two partial streams 6 and 7. While the first partial stream 6 is expanded in the expander X, which is coupled to the first compressor C1 that is yet to be described, and then is fed via line 6' to the demethanizer T, the second partial stream 7 is cooled in the heat exchanger E2, condensed, and then is fed via line 8 and expansion valve V3 to the upper region of the demethanizer T.

The $C_{2+}$-hydrocarbon-rich (product) fraction 9 that is to be obtained is drawn off from the bottom of the demethanizer T, and is fed to a further use, for example, to a fractionation and then as a feedstock fraction for an olefin unit.

At the head of the demethanizer T, a methane-rich fraction 10 is drawn off and heated in the heat exchanger E2 against the second partial liquid stream 4 that is to be sub-cooled as well as against additional process streams. Via line 11, this fraction then is fed to the heat exchanger E1, where it is further heated against the hydrocarbon-rich fraction 1 that is to be condensed, and then is fed via line 12 to a first compressor C1. In compressor C1, the pressure of the methane-rich fraction is increased by 2 to 10 bar. Then, the compressed methane-rich fraction is fed via line 13 to a second compressor C2 and is further compressed in the latter to the desired release pressure, which is preferably 40 to 60 bar. The compressed methane-rich fraction is then removed from the system via line 14 and can optionally be subjected to further compression.

A partial stream of the methane-rich fraction that is compressed to the release pressure of the compressor C2 is fed via line 15 to the heat exchanger E1, cooled in the latter, partially condensed, and then fed via line 15' to the heat exchanger E2, further condensed in the latter as well as sub-cooled, and then fed as (main) reflux via line 16 and regulating valve V4 to the demethanizer T.

As heat exchangers E1 and E2, preferably multi-stream plate exchangers are used, but several tube bundle exchangers can also be provided. The heat exchanger or reboiler E3 that is yet to be described is preferably a tube bundle heat exchanger, which, however, is required only for the separation of $C_{3+}$-hydrocarbons that is yet to be described.

In the embodiment, depicted in FIG. 1, of the method according to the invention, the demethanizer T has three heating circuits 20/20', 21/21', and 22/22'. For the sake of clarity, the (regulating) valves that are necessary in these heating circuits are not shown. Three different intermediate fractions are drawn off from the demethanizer T via the previously-mentioned heating circuits, partially evaporated at different temperature levels, and then again fed to rectification fractionation or to the demethanizer T. While the intermediate fractions circulating in the two heating circuits 20/20' and 21/21' located at the highest temperature levels are partially evaporated against the hydrocarbon-rich fraction 1 that is to be partially condensed in the heat exchanger E1, the intermediate fraction of the heating circuit 22/22' located at the lowest temperature level in the heat exchanger E2 is partially evaporated against process streams that are to be (sub-) cooled.

The temperature level of the three heating circuits lies below the temperature of the hydrocarbon-rich feedstock fraction 1 that is to be cooled or condensed in the separation of $C_{2+}$-hydrocarbons, and thus external heating by steam or hot oil in the heat exchanger or reboiler E3 is not necessary. If a separation of $C_{3+}$-hydrocarbons is now to be carried out, the bottom temperature of the demethanizer T increases noticeably, namely from ambient temperature to about 100° C. It is thus no longer possible to heat the demethanizer T with the hydrocarbon-rich feedstock fraction; rather, external heating would be necessary. Moreover, the entire temperature profile increases in the demethanizer T, which then performs the function of a deethanizer.

According to the invention, the removal of the intermediate fraction circulating in the heating circuit 20/20' located at the highest temperature level is now interrupted at least temporarily. In the meantime, the intermediate fraction of the heating circuit 21/21' located at the medium temperature level is partially evaporated at the temperature level at which the intermediate fraction circulating in the heating circuit 20/20' located at the highest temperature level was partially evaporated. To this end, the intermediate fraction of the heating circuit 21/21' is fed to and drawn off from the heating circuit 20/20' via the line sections a and b, respectively, shown in dashed-dotted lines. This has the result that the intermediate fraction, which previously was partially evaporated at the cold end of the heat exchanger E1, is now partially evaporated at the warm end of the heat exchanger E1 against the hydrocarbon-rich feedstock fraction that is to be condensed.

At the same time, the intermediate fraction of the heating circuit 22/22' located at the lowest temperature level is partially evaporated at the temperature level at which the intermediate fraction circulating in the heating circuit 21, 21' located at the medium temperature level was partially evaporated. To this end, the intermediate fraction of the heating circuit 22/22' is fed to and drawn off from the heating circuit 21/21' via the line sections c and d, respectively, shown in dashed-dotted lines. The intermediate fraction of the heating circuit 22/22', which previously was partially evaporated in the heat exchanger E2, is now partially evaporated at the cold end of the heat exchanger E1 against the hydrocarbon-rich feedstock fraction that is to be condensed.

At the same time, in addition, a partial stream 9' from the bottom of the demethanizer T—which now acts as a deethanizer—is partially evaporated in the heat exchanger or reboiler E3 against a suitable external medium, for example steam, hot oil, etc., and is fed as a bottom heating to the de(m)ethanizer T. In this connection, the external medium should be able to provide heat at a temperature level of at least 100° C. The bottom heating via the reboiler E3 is permanently in operation during the operating mode: "recovery of $C_{3+}$-hydrocarbons." During the operating mode: "recovery of $C_{2+}$-hydrocarbons," the reboiler E3 can be used as a so-called trim-reboiler.

Via line 9, a $C_{3+}$-hydrocarbon-rich fraction that is obtained from the deethanizer T is drawn off from the bottom of the deethanizer T and is fed for further use, for example, to a fractionation and then as a feedstock fraction for an olefin unit.

The previously-described way in which this method is performed thus makes it possible to use the method according to the invention for separating $C_{2+}$-hydrocarbons from a hydrocarbon-rich fraction (temporarily) for separating $C_{3+}$-hydrocarbons, whereby the yield of $C_3$-hydrocarbons remains consistently high.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The entire disclosures of all applications, patents and publications, cited herein and of corresponding German patent application DE 10 2012 017 485.3, filed Sep. 4, 2012, are incorporated by reference herein.

The invention claimed is:

1. A method for separating $C_{2+}$-hydrocarbons or $C_{3+}$-hydrocarbons from a hydrocarbon-rich fraction, said method comprising:

a) partially condensing the hydrocarbon-rich fraction is, b) separating the partially condensed hydrocarbon-rich fraction into a gaseous fraction and a liquid fraction, c) subjecting said gaseous fraction and said liquid fraction to rectification fractionation to produce a methane-rich fraction and a $C_{2+}$- or $C_{3+}$-hydrocarbon-rich fraction, d) compressing the methane-rich fraction obtained from the rectification fractionation, e) condensing a partial stream of the compressed methane-rich fraction and feeding the condensed partial stream of the compressed methane-rich fraction as reflux to the rectification fractionation, f) providing at least three heating circuits via which intermediate fractions withdrawn from the rectification fractionation are partially evaporated and fed back to the rectification fractionation, g) wherein at least the intermediate fractions circulating in the two heating circuits located at the highest temperature levels are partially evaporated against the hydrocarbon-rich fraction that is to be partially condensed, wherein removal of the intermediate fraction circulating in the heating circuit located at the highest temperature level is at least temporarily interrupted, during the temporary interruption of removal of the intermediate fraction circulating in the heating circuit located at the highest temperature level, a partial stream of a bottom fraction obtained from the rectification fractionation is partially evaporated against an external medium and is fed as a bottom heating to the rectification fractionation, and during the temporary interruption of removal of the intermediate fraction circulating in the heating circuit located at the highest temperature level, the other two intermediate fractions, in each case at the temperature level at which the intermediate fraction circulating in the heating circuit located at the next-higher temperature level was partially evaporated, are partially evaporated.

2. The method according to claim 1, wherein said hydrocarbon-rich fraction is from natural gas.

3. The method according to claim 1, wherein during the temporary interruption of removal of the intermediate fraction circulating in the heating circuit located at the highest temperature level, the intermediate fraction of the heating circuit (21, 21') located at the medium temperature level is partially evaporated (E1) at the temperature level at which the intermediate fraction circulating in the heating circuit (20, 20') located at the highest temperature level was partially evaporated, and during the temporary interruption of removal of the intermediate fraction circulating in the heating circuit located at the highest temperature level, the intermediate fraction of the heating circuit (22, 22') located at the lowest temperature level is partially evaporated (E1) at the temperature level at which the intermediate fraction circulating in the heating circuit (21, 21') located at the medium temperature level was partially evaporated.

4. The method according to claim 1, wherein said liquid fraction (2) obtained in b) is separated into a first partial stream (2') and a second partial stream (4), said first partial stream (2') is partially evaporated (E1) and then is fed to rectification fractionation (T), and said second partial stream (4) is undercooled (E2) and then is fed as additional reflux (4') to rectification fractionation (T).

5. The method according to claim 4, wherein said first partial stream (2') is partially evaporated (E1) against the hydrocarbon-rich fraction (1) that is to be partially condensed.

6. The method according to claim 4, wherein the evaporation pressure of said first partial stream (2', 3) is variable (V1, V2).

7. The method according to claim 4, wherein said second partial stream (4) is sub-cooled (E2) against the methane-rich fraction (10) obtained in rectification fractionation (T).

8. The method according to claim 4, wherein the sub-cooled second partial stream (4') is fed as reflux to the rectification fractionation (T) at a feed point below the feed point of the condensed partial stream of the compressed methane-rich fraction used as reflux (16).

* * * * *